United States Patent [19]

Morgan

[11] 4,422,573

[45] Dec. 27, 1983

[54] HEATING SYSTEM

[75] Inventor: Frederick R. Morgan, Marlow, England

[73] Assignee: Radiant Tube Systems Limited, London, England

[21] Appl. No.: 332,014

[22] Filed: Dec. 18, 1981

[30] Foreign Application Priority Data

Nov. 5, 1981 [GB] United Kingdom ..... 8133360

[51] Int. Cl.[3] ..... F24H 3/00

[52] U.S. Cl. ..... 237/70; 126/91 A; 165/49

[58] Field of Search ..... 126/91 A, 91 R; 237/70, 237/69; 165/47, 49

[56] References Cited

U.S. PATENT DOCUMENTS 2,064,095 12/1936 Wilson ..... 126/91 A 2,946,510 7/1960 Galvin ..... 126/91 A

FOREIGN PATENT DOCUMENTS 606020 11/1924 France ..... 126/91 A

*Primary Examiner*—Albert J. Makay

*Assistant Examiner*—Henry Bennett

*Attorney, Agent, or Firm*—C. O. Marshall, Jr.

[57] ABSTRACT

The invention provides a complete heating system for large buildings in which waste process gas is circulated around a loop of duct which is above the space to be heated and radiates downwardly in said space. Purging and diluting air supplies into and from the duct are provided, and also separate input means for use when process gas is unavailable or unsuitable.

4 Claims, 5 Drawing Figures

HEATING SYSTEM

This invention relates to heating systems of the kind comprising an endless loop of duct suspended high in the space to be heated, and said duct having an exposed lower surface arranged to radiate heat when the surface is heated, said duct having its upper surface insulated against heat loss and its lateral surfaces provided with convection spoilers to minimise heat transfer by induced currents of ambient air flowing past said surfaces. Such a heating system is described for example in British Pat. No. 1,008,480.

The problems with such heating installations are that a very high temperature needs to be maintained in the duct in order for the radiant heating effect to be useful. According to Stefan Boltzmanns formula, the radiant heating effect $=KeT^4$, where K is a constant, e the emissivity of the surface and T the absolute temperature. In other words, the useful effect is proportional to the fourth power of the temperature, and this is why high temperatures are desirable.

The main advantage of such a system is due to the heating medium, which may be air or combustion gases. These can be at low pressure and hence the nature of the joints in the duct can be simple. Moreover, small leakages may be unimportant, unlike the situation where water or steam are used as the heating fluid. For the same reasons, the ducts can be made of lightweight sheet metal and manufacturing costs and installation costs, particularly in structural work to support the ducts, can be simplified.

It happens, however, that air or combustion gases present problems because their volumetric specific heats (defined as the product of specific heat and specific gravity) are very much lower than those of water or wet steam. This means that to achieve a worthwhile heating effect it is necessary not only to have the ducts at high temperature, but also to make the cross-section of the ducts large enough to pass a high volume of heating fluid.

These factors have together restricted the use of space heating systems of this kind in the past, but with greatly increased fuel costs in recent years, the very high thermal efficiency together with the reduced fabric and ventilation losses which is possible with these systems has focused attention upon them and made their further development desirable in the interests of fuel conservation.

The object of the invention is to provide a particularly efficient system of this kind. A further object of the invention is to enable waste process heat to be used in such a system, thereby further minimising the use of specific fuel sources for the heating.

In accordance with the invention, a space heating system comprises an endless loop of duct suspended high in the said space, said duct having an exposed lower surface arranged to radiate heat when said surface is heated, said duct having its upper surface insulated against heat loss and its lateral surfaces provided with convection spoilers to minimise heat transfer by currents of ambient air flowing past said surfaces, and said duct loop including a first inlet connection for fresh air for the first purpose of providing a purging flow of air through said duct, and for the second purpose of providing a diluting flow of said air at ambient temperature to reduce or limit the duct temperature; a second inlet connection for process combustion products at elevated temperatures; an outlet connection communicating externally of said space; at least one of a fuel fired burner in line with said duct so as to direct combustion products of the fuel along said duct, and a heat exchanger having first passages in line with said duct and second passages in heat transfer relationship with the first passages and communicating to a fuel fired burner system; a separate damper in each of said inlet and outlet connections; a further damper in said duct between said inlets and said outlet; and fan means for moving gases in and along said loop.

The duct may be of the same configuration as described in said British Pat. No. 1,008,480, which includes the possibility of providing a series of circular cross section lightweight sheet metal ducts, and these may be made by spirally winding a continuous strip of sheet metal and forming a continuous seam along the spiral edge. This allows comparatively long lengths of duct to be made in simple fashion. Banks of two or three such ducts may be provided of suitable diameters to carry the volume of air/gas required, and the bank may be overlaid with a blanket of insulation material, provided with the lateral spoilers against convection flow, which trap hot air in a somewhat triangular cross section space between each of the lateral ones of the bank of ducts and the spoilers, and the ducts may be suspended by chains or other flexible means so as to give free play for expansion and contraction in heating up and cooling down.

The fresh air inlet may open from the space to be heated, or air can be drawn from externally of the building or structure being heated according to requirements. Usually it will open from the interior of the building or structure, and it may comprise a lateral spur from said complete loop of duct and with its damper located near to the open end through which air is drawn into the system. The invention intends to use process combustion products at elevated temperatures: that is to say the flue gas from a furnace, kiln or heat treatment apparatus, purely by way of example. The flue gas temperature may be higher than permissible for the heating system, the limit on such temperature being placed by factors such as the nature of the material used for the ducts and in particular the construction of the fan. As mentioned hereinbefore, it is usually desirable to run the ducts at as high a temperature as possible in the interests of thermal efficiency, and a system will normally have a "design temperature" which may be (typically, and by way of example but without limitation) 250° C.

However, the availability of process gas depends upon the process being carried out, and it is often necessary to provide space heating at times when the process is not in operation, or it may be that the process is operated intermittently and again heating is required at other times. For that reason the alternative heating means mentioned, and again described hereinafter, are provided additionally.

The process gas inlet desirably opens to the lateral connection for purging and diluting air, rather than directly to the loop, and in this case opens between the fresh air damper and the duct, and the damper in the process gas inlet lies between said lateral connection and the process gas flue or like. This is so that excessively hot process gas can be immediately diluted with fresh air in order to bring the temperature down to the design temperature of the system before said gas enters the said loop.

The outlet connection desirably extends externally of the building or structure being heated, so as to avoid fumes and undesirable contamination of the internal atmosphere of the building. The discharge may be into an appropriate chimney or possibly into the process flue according to needs.

In order to provide for adequate heat output from the system at times when process heat is unavailable or inadequate, two alternative heating means are possible, and the invention requires at least one of these to be provided. In general only one of the two will be provided. One possibility is to use a direct fired system in which fuel, for example natural gas, is burnt in an appropriate burner structure which fires its flame along the length of a combustion chamber which is in line with the duct. The impeller fan for circulating gas around the duct will normally be upstream of the direct fired burner, so as to draw the coolest possible circulating gas over the fan and direct it into said combustion chamber.

The alternative heating system is an indirect one in which the combustion products from a burner system are sent through a heat exchanger before passing to a flue, which may be the process gas flue, and the duct gases are circulated through the heat exchanger in heat transfer relationship but without coming into contact with the combustion products.

The selection of a direct fired or indirect fired heating system is based on the normal factors which will be understood by the man skilled in the art, in particular the temperature of the combustion products and the relationship of that temperature to the said design temperature of the system; and the possibility of contaminants, poisonous gases and the like in the combustion products.

The whole system, including the damper located between the outlet and the inlet lateral spur may be interconnected by manual and or automatic controls operated by temperature sensors via appropriate relays.

The operation of the automatic system will be further described with reference to the accompanying drawings wherein.

Figure 5:
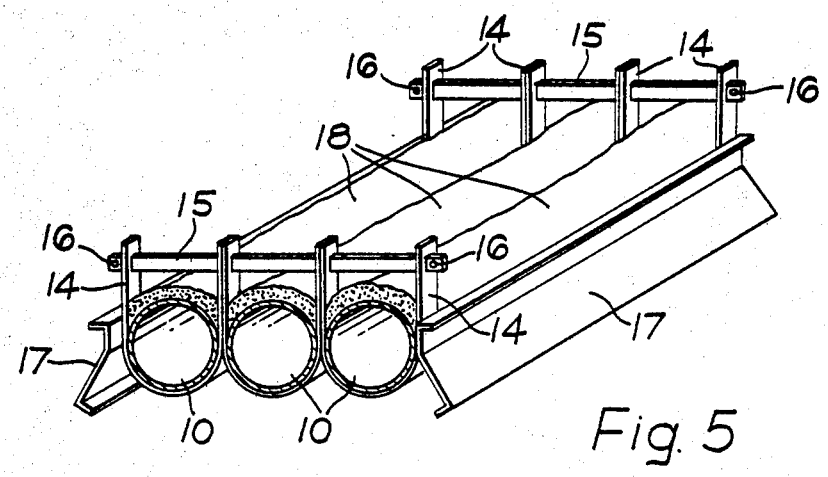
FIG. 5 is a view corresponding to FIG. 3 of said British Pat. No. 1,008,480 included herein for the sake of completeness and for the better understanding of a typical duct system.

Referring first to FIG. 5, this shows a bank of three circular cross section ducts 10 which are located as close together as possible so as to avoid any substantial gaps between them through which convection losses might occur, and individually suspended by somewhat U-shaped straps 14 threaded by cross pins 15 so that apertures 16 in the ends of the pins can couple suspension chains. Convection spoilers 17 are located at both sides of the bank and extend below a tangent common to all three ducts and lying across the lower surfaces of the same, so as to provide adequate entrapment of heated air for the purpose described. It will be noted that the convection spoilers 17 have inturned edges to increase the effect. The top surface of the duct is overlaid with a blanket of insulation material 18.

Alternative ducts are possible, the important factors being the total cross sectional area of the ducts, which is related to the volume of gas required in order to obtain a given heating effect having regard to the speed of flow of the gas and its temperature; and the cross sectional shape of the radiating portion of the duct is also important because radiation is effectively at right angles to the surface. It is desirable that the whole of the ground level area of the space to be heated is bathed in the radiant emission.

Figure 1:
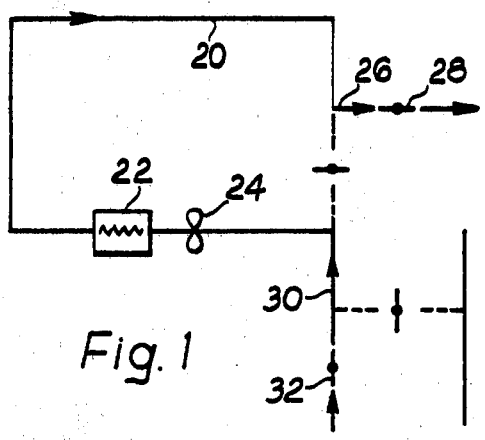
FIGS. 1 to 4 are schematic diagrams showing a system substantially as mentioned and with the dampers in different positions according to four successive possibilities.

Turning now to the schematic flow diagrams, FIG. 1 shows an arrangement in which the system is in purged condition. The system consists of the loop of duct 20 with the direct or indirect heater 22 located downstream of the impeller fan 24. Outlet branch 26 includes damper 28, an inlet branch 30 includes fresh air control damper 32. Air is drawn in through the branch 30 by the fan 24 and circulated through the loop duct and out via the outlet 26. This purging operation may be carried on automatically whenever the heating system is first switched on, and may also take place automatically before and after process gas is used in the system. These aspects of the automatic control will be more particularly referred to hereinafter.

Figure 2:
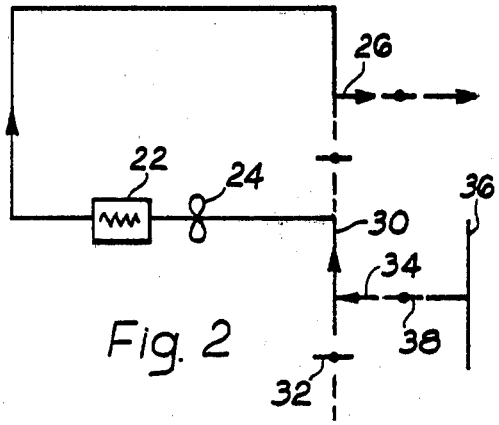

FIG. 2 shows the same circuit as in FIG. 1, in generally the same condition, except that here the fresh air damper 32 is in a closed position, and the lateral branch 34 connected into the inlet 30 and also to the process gas line 36 is brought into the circuit by opening damper 38 in that line 34. In the FIG. 2 position process gas from the flue 36 is taken through the loop and discharged via outlet 26, thus heating the duct and, by radiation, the space which is to be heated. The gas is not recirculated.

Figure 3:
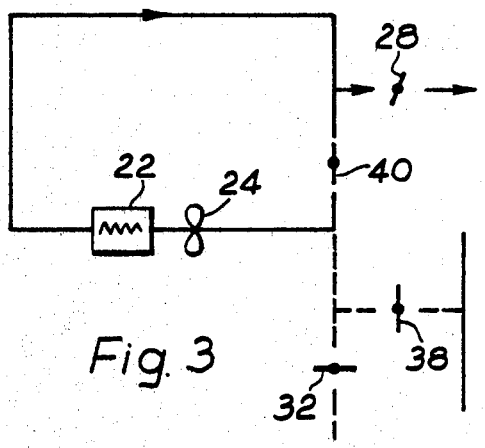

In FIG. 3 the process gas and fresh air lines are closed off by the dampers 32 38. Damper 40 in the line which completes the loop, and extends from the outlet to the inlet in the loop is in the open condition. FIG. 3 shows the damper 28 in an intermediate position so that if the heater 22 is a direct fuel fired system, firing the products of combustion along the duct, a proportion of those combustion products are discharged through the outlet 26 and a proportion continue to recirculate. Obviously the volume discharged is approximately equal to that introduced into the system so as to maintain volume and pressure in the duct within the design limits.

However, if the unit 22 is an indirect fired system using a heat exchanger, damper 28 will be in the closed position in this mode for complete (endless) recirculation. FIG. 3 thus represents the position where the heating effect is being obtained by fuel via unit 22, in contrast to FIG. 2 which shows the position where the heating effect is obtained from process gas from a chimney or like 36.

Figure 4:
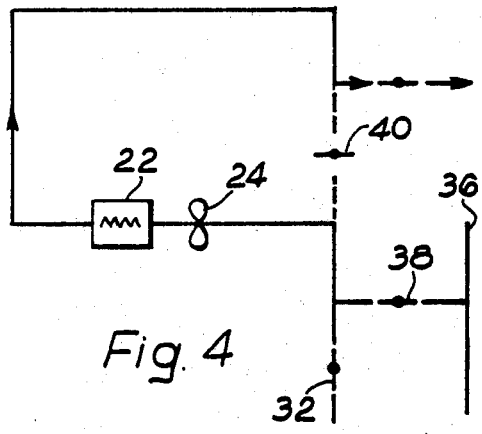

FIG. 4 is similar to FIG. 2 but shows the position in which process gas is diluted by air by having damper 32 open at the same time as damper 38, and since this mode is utilised when the process gas is excessively hot, it follows that it is undesirable to recirculate gases and damper 40 is in the closed position.

However there is again an alternative possibility of having damper 40 in a partly or fully open position and damper 28 likewise, so that a proportion of the furnace gases are recirculated and a proportion are bled to exhaust, to suit circumstances and need.

The FIG. 2 or FIG. 4 condition may be initiated automatically by a temperature probe located in the process line 36, and arranged, upon temperature in that line passing a predetermined minimum figure to close dampers 38, 40, and open dampers 28 and 32 so as to put the circuit into the FIG. 1 condition. After a predetermined delay of the order of a few minutes only, the automatic controls will close damper 32 and open damper 38 so as to put the circuit into the FIG. 2 condition. After a further predetermined delay of a rather longer duration, a temperature probe in the main duct circuit may operate the dampers 28 and 40 so as to cause the process gas to be recirculated, and in the event that temperature in the duct rises to above a predetermined maximum, the same temperature probe or a further one may automatically open damper 32 so as to introduce diluting cold air at ambient temperature and at the same time close damper 40 and fully open damper 28, that is turn the circuit to FIG. 4 condition.

If and when the duct temperature probe indicates that temperature has fallen below the maximum, the system may revert to one of the earlier mentioned conditions, and if and when the process gas temperature probe indicates that temperature in that line has fallen below a minimum level, the system may automatically revert to the FIG. 1 condition for a few minutes for purging purposes, and then to the FIG. 3 condition for ordinary heating.

All of these controls may be effected automatically, or manually.

Having now described my invention what I claim is:

1. A space heating system comprising an endless loop of duct suspended high in the said space, said duct having an exposed lower surface arranged to radiate heat when said duct is heated, having an upper surface insulated against heat loss and having lateral surfaces provided with convection spoilers to minimize heat transfer by currents of ambient air flowing past said surfaces, a fan in said loop for moving gases in and along said loop, and an auxiliary heater which is arranged to heat gases flowing in said loop and is located adjacent to the downstream side of the fan, wherein the improvement comprises (a) a branch duct having its one end connected to a source of process gas combustion products and its other end connected to said loop adjacent to the upstream side of the fan, (b) a dampered fresh air inlet connected to said branch duct for diluting the process gas to limit its temperature, (c) a damper in said branch duct, between said air inlet and the source of process gas, which can be closed to permit said loop to be purged with air, (d) a dampered outlet connected to said loop at a point remote from the downstream side of the fan, and (e) a damper in said loop between said outlet and said branch duct to control recirculation.

2. A space heating system as claimed in claim 1 wherein said fresh air inlet comprises a lateral spur from the complete loop and opening from the interior of the building, and with a damper located near the open end of the spur.

3. A space heating as claimed in claim 2 wherein the process gas inlet opens to the lateral spur between said damper and the duct loop.

4. A space heating system as claimed in claim 1 wherein the outlet connection opens to the exterior of the building.

* * * * *